US008069799B2

(12) United States Patent
Tseng et al.

(10) Patent No.: US 8,069,799 B2
(45) Date of Patent: Dec. 6, 2011

(54) THREAD CUTTING DEVICE FOR A SEWING MACHINE

(75) Inventors: Shui-Chun Tseng, Taiping (TW); Ming-Horng Lin, Taiping (TW)

(73) Assignee: Zeng Hsing Industrial Co., Ltd., Taiping (TW)

( * ) Notice: Subject to any disclaimer, the term of this patent is extended or adjusted under 35 U.S.C. 154(b) by 464 days.

(21) Appl. No.: 12/319,632

(22) Filed: Jan. 9, 2009

(65) Prior Publication Data

US 2010/0175602 A1 Jul. 15, 2010

(51) Int. Cl.
*D05B 65/02* (2006.01)
*D05B 65/00* (2006.01)

(52) U.S. Cl. ..... 112/292

(58) Field of Classification Search ..... 112/289–298; 83/910, 936–941
See application file for complete search history.

(56) References Cited

U.S. PATENT DOCUMENTS

| | | | | |
|---|---|---|---|---|
| 3,605,664 | A * | 9/1971 | Hedegaard | 112/292 |
| 3,776,161 | A * | 12/1973 | Papajewski et al. | 112/292 |
| 4,098,208 | A * | 7/1978 | Hedegaard | 112/291 |
| 4,437,423 | A * | 3/1984 | Yamazawa | 112/292 |
| 6,516,735 | B2 * | 2/2003 | Hintzen et al. | 112/298 |

FOREIGN PATENT DOCUMENTS

WO WO9209735 A1 * 6/1992

* cited by examiner

*Primary Examiner* — Ismael Izaguirre
(74) *Attorney, Agent, or Firm* — David N. Lathrop

(57) ABSTRACT

A thread cutting device for a sewing machine with a hook rotatable in a vertical plane includes a drive motor, a fixed knife which has a working-side wall extending towards a thread fetching zone of the sewing machine to terminate at a first cutting edge, and a movable knife which is driven by the drive motor to angularly move between fetching and thread cutting positions in a vertical plane. The movable knife has a lateral edge surface defining a cavity in an intermediate segment thereof to engage lower and upper threads when the movable knife reaches the fetching position. The movable knife has a second cutting edge disposed to press the first cutting edge so as to complete a cutting action.

4 Claims, 6 Drawing Sheets

THREAD CUTTING DEVICE FOR A SEWING MACHINE

BACKGROUND OF THE INVENTION

1. Field of the Invention

This invention relates to a sewing machine, more particularly to a sewing machine with a thread cutting device for cutting both upper and lower threads in a sewing machine.

2. Description of the Related Art

Conventional sewing machines either include hooks rotating in a horizontal plane, such as those disclosed in U.S. Pat. Nos. 5,964,170 and 6,276,289 B1, or have hooks rotating in a vertical plane, such as those disclosed in U.S. Pat. Nos. 6,152,058 and 5,771,828.

The sewing machine disclosed in U.S. Pat. No. 6,152,058 includes a thread cutting device extending in a horizontal direction, and including a fixed knife and a movable knife which cooperate with each other to cut either one or both of upper and lower threads. The movable knife is operable to cut the upper thread at a first timing and to cut the lower thread at a second timing. In order to permit selective cutting of both the upper and lower threads or only the upper thread, the thread cutting device has a complicated construction, thereby resulting in high manufacturing costs and complicated operation.

SUMMARY OF THE INVENTION

An object of the present invention is to provide a sewing machine with a thread cutting device which has a simple construction and which can simultaneously cut upper and lower threads.

According to this invention, the thread cutting device for a sewing machine includes a drive motor, a fixed knife, a mounting post, and a movable knife.

The fixed knife is disposed proximate to a bobbin side surface of a base housing of the sewing machine, and has a working-sidewall extending towards a thread fetching zone under a needle plate to terminate at a first cutting edge.

The mounting post has an actuated end coupled with the drive motor so as to be moved angularly about an axis that is parallel to a rotating axis of a hook, and a mount end that is opposite to the actuated end in a longitudinal direction parallel to the axes.

The movable knife includes a base end connected to the mount end of the mounting post so as to be movable between a fetching position and a thread cutting position, a probe end opposite to the base end in a lengthwise direction, and an intermediate segment interposed between the base end and the probe end. The movable knife has sweeping and hook confronting surfaces, and a lateral edge surface configured to connect the sweeping and hook confronting surfaces. The lateral edge surface has a cavity in the intermediate segment. The cavity extends transversely to communicate the sweeping surface with the hook confronting surface such that, once the movable knife has reached the fetching position, tensed lower and upper threads in the sewing machine are engaged in the cavity. The movable knife has a second cutting edge that is disposed on the sweeping surface between the probe end and the cavity, and that is configured such that, when the probe end is on the way to the thread cutting position, the second cutting edge is brought to press the first cutting edge so as to complete a cutting action.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
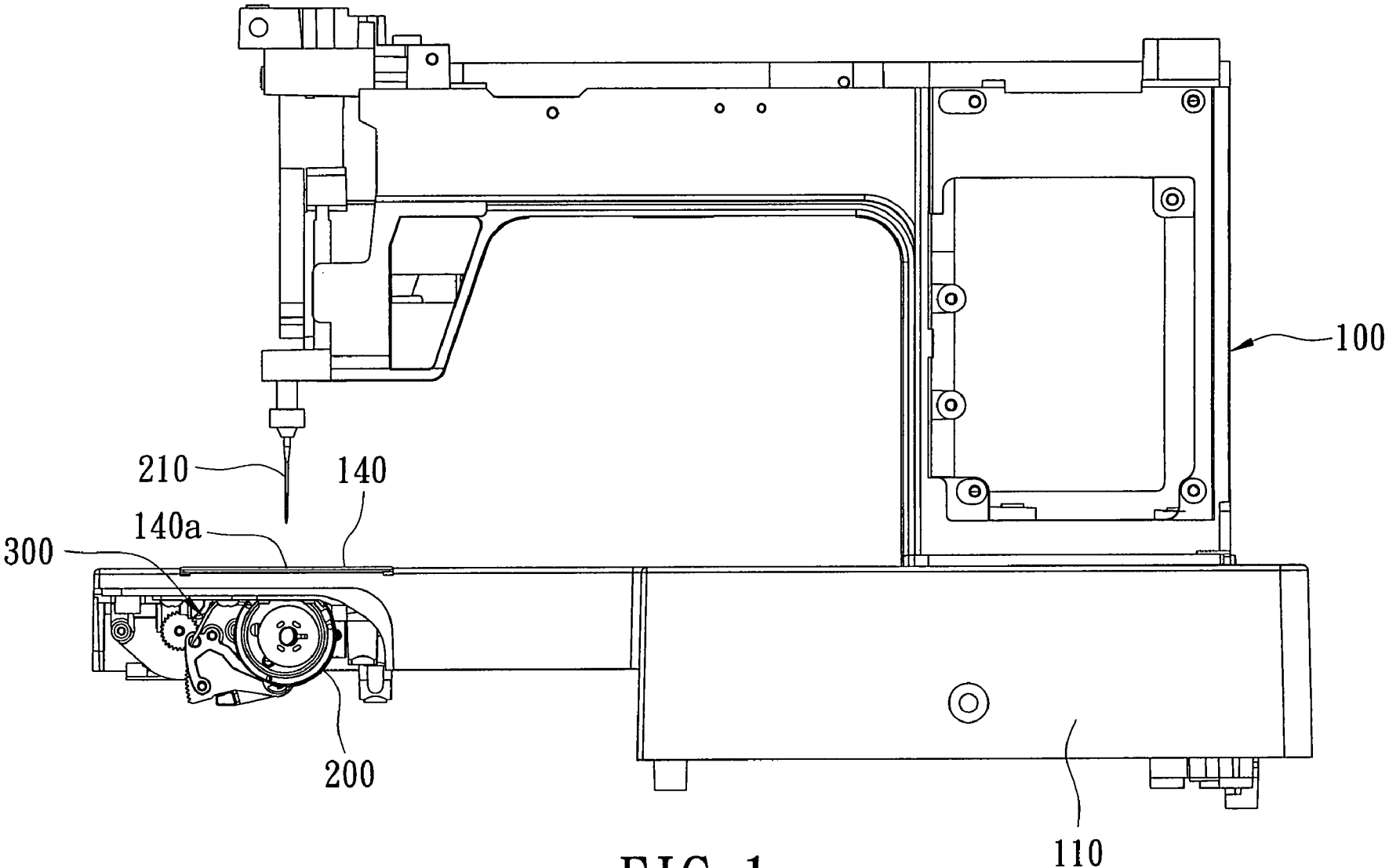
FIG. 1 is a front view of the preferred embodiment of a thread cutting device according to this invention when incorporated in a sewing machine.
Figure 2:
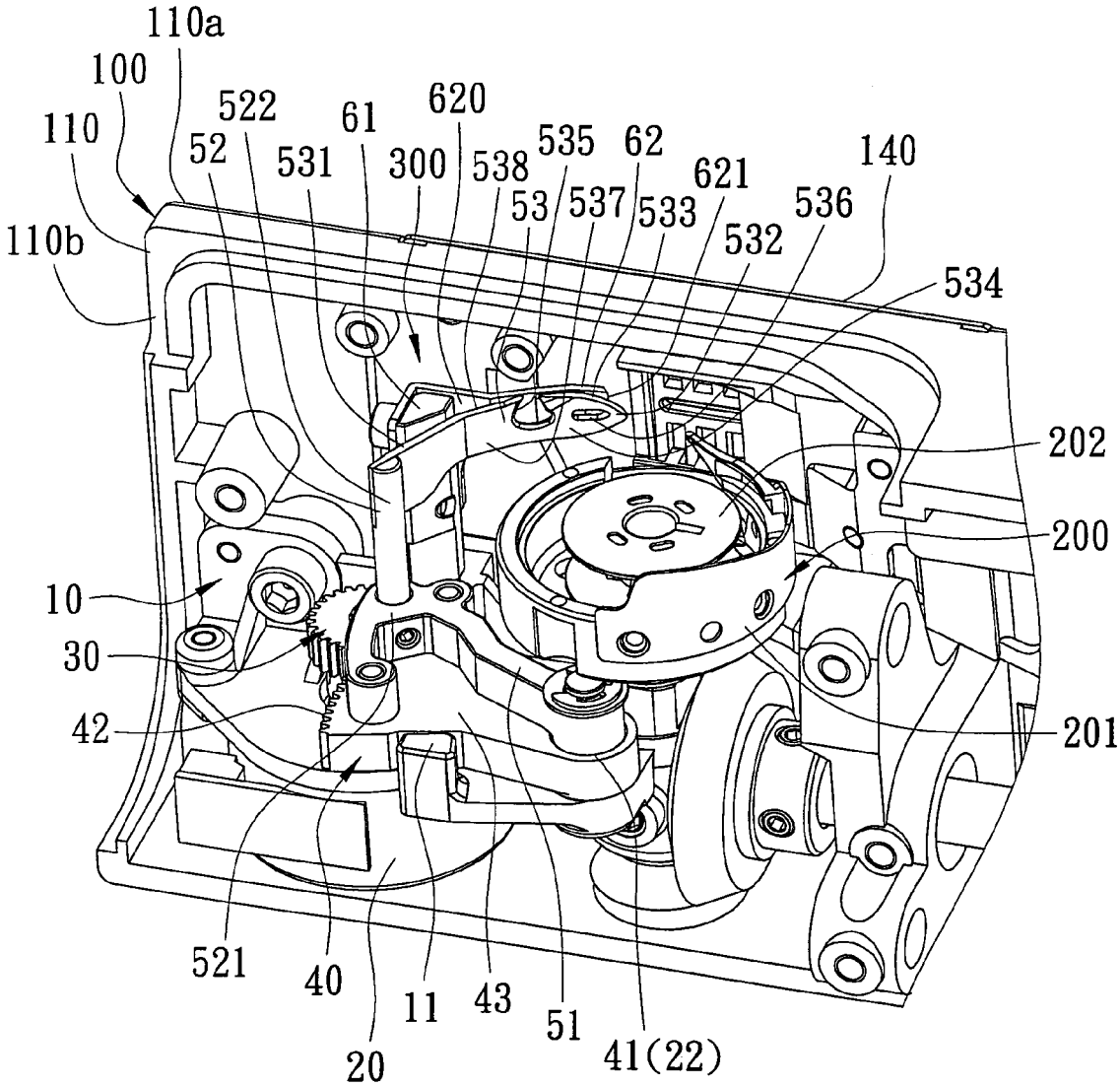
FIG. 2 is a fragmentary perspective view showing the interior construction of the sewing machine with the thread cutting device of the preferred embodiment.
Figure 3:
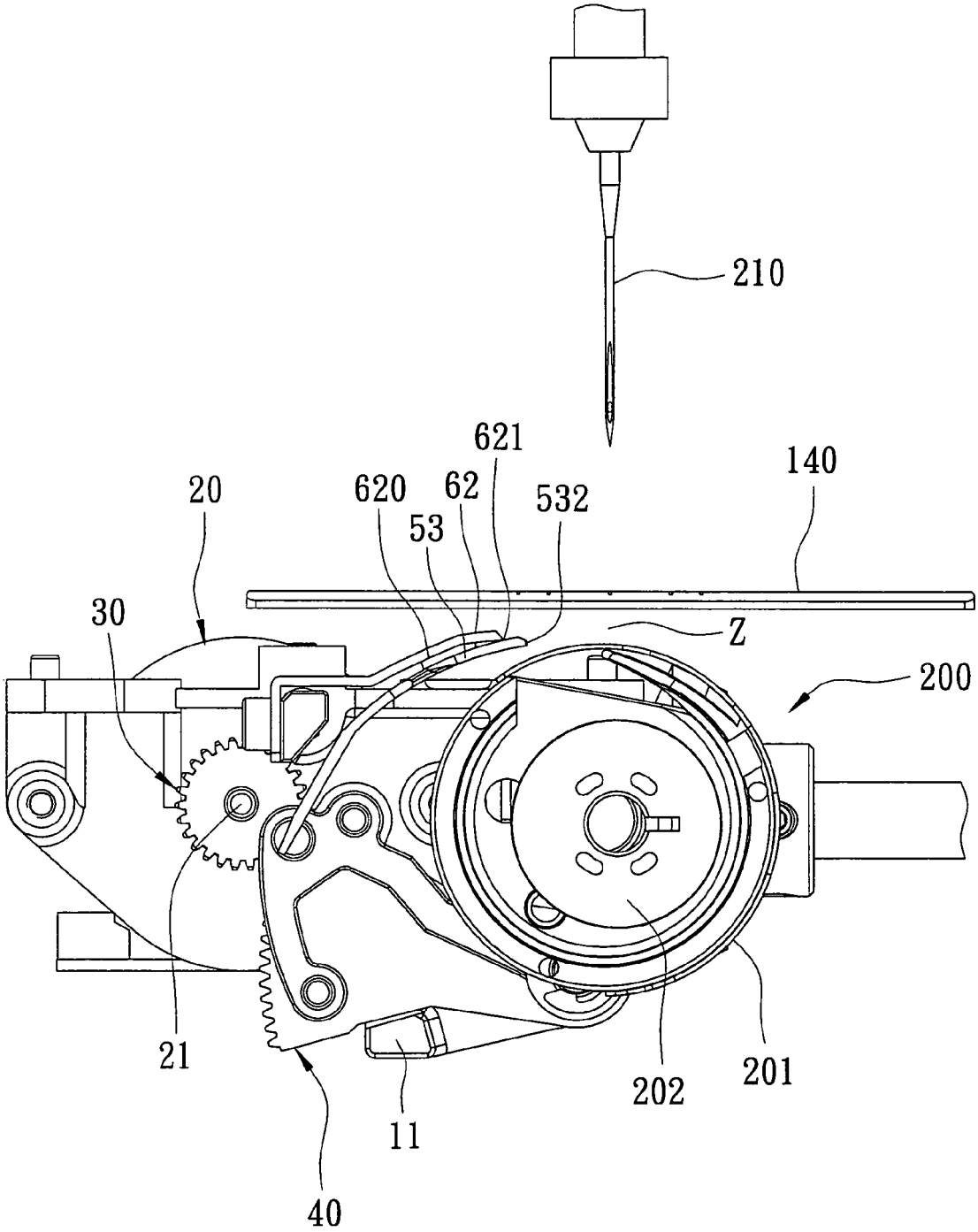
FIG. 3 is a schematic view of the preferred embodiment, showing a movable knife in an initial position relative to a fixed knife.

Referring to FIGS. 1 to 3, the preferred embodiment of a thread cutting device 300 according to the present invention is shown to be mounted in a sewing machine 100. The sewing machine 100 generally includes a base housing 110 which has needle-bar side and bobbin side surfaces (110*a*,110*b*) opposite to each other in an upright direction, a needle plate 140 which is fitted in the needle-bar side surface and which has a needle hole (140*a*), a needle 210 which is threaded with an upper thread (not shown) and which is disposed to reciprocate through the needle hole (140*a*) along a piercing path to thereby bring the upper thread to upper and lower limits alternately, a hook assembly 200 which is spaced apart from the needle plate 140 to define a thread fetching zone (Z), and which has a rotating hook 201 configured to travel around a first axis in a longitudinal direction that is transverse to the upright direction so as to form a looped segment of the upper thread by hooking up the upper thread from the needle 210, a bobbin 202 which is disposed to be reelable about the first axis in the hook assembly 200, and which is configured to tensely deliver a lower thread (not shown) into the thread fetching zone (Z) so as to enable the lower thread to be interlocked with the upper thread through tying of the looped segment while the upper and lower threads are tensed.

The thread cutting device 300 is shown to comprise a support frame 10, a drive motor 20, a driving gear 30, a mounting shaft 22, a driven gear 40, a positioning member 51, first and second mounting posts 52,61, a fixed knife 62, and a movable knife 53.

The support frame 10 is disposed adjacent to the hook assembly 200, and has a stop member 11. The drive motor 20 is a servomotor, and has an output shaft 21. The driving gear 30 is disposed on and is rotated with the output shaft 21 of the servomotor 20. The mounting shaft 22 is disposed to extend along a second axis parallel to the first axis. The driven gear 40 is of a sector shape, and includes a pivoted end 41 which is rotatably mounted on the mounting shaft 22 about the second axis, a toothed segment 42 which is opposite to the pivoted end 41 radially, and which is meshed with the driving gear 30, and a web portion 43 interposed between the pivoted end 41 and the toothed segment 42. The driven gear 40 is controlled by the servomotor 20 to turn about the second axis relative to the stop member 11.

The positioning member 51 is securely disposed on the web portion 43. The first mounting post 52 has an actuated end 521 which is secured on the positioning member 51 proximate to the toothed segment 42 so as to be angularly movable about the second axis, and a mount end 522 which is opposite to the actuated end 521 in the longitudinal direction. The second mounting post 61 is secured on the support frame 10.

The fixed knife 62 is secured to and extends from the second mounting post 61 proximate to the bobbin side surface (110*b*), and has a working-side wall 620 which is disposed to face away from the bobbin side surface (110*b*), and which extends towards the thread fetching zone (Z) to terminate at a first cutting edge 621. Thus, the fixed knife 62 is cantilevered so as to vest the first cutting edge 621 with a certain degree of yieldability.

The movable knife 53 includes a base end 531 connected to the mount end 522 of the first mounting post 52 so as to be movable by turning of the driven gear 40 between a fetching position and a thread cutting position, a probe end 532 opposite to the base end 531 in a lengthwise direction, and an intermediate segment 537 interposed between the base end 531 and the probe end 532. In addition, the movable knife 53 has a sweeping surface 533 which extends from the intermediate segment 537 to the probe end 532 and which is disposed to confront the working-side wall 620 of the fixed knife 62, a hook confronting surface 534 which is opposite to the sweeping surface 533, and a lateral edge surface 538 configured to connect the sweeping surface 533 and the hook confronting surface 534. The lateral edge surface 538 has a cavity 535 in the intermediate segment 537. The cavity 535 extends transversely relative to the lengthwise direction to communicate the sweeping surface 533 with the hook confronting surface 534. The movable knife 53 further has an inner peripheral wall 536 which is formed between the probe end 532 and the cavity 535 and which extends transversely relative to the lengthwise direction to communicate the sweeping surface 533 with the hook confronting surface 534 so as to form a second cutting edge 536.

Figure 4:
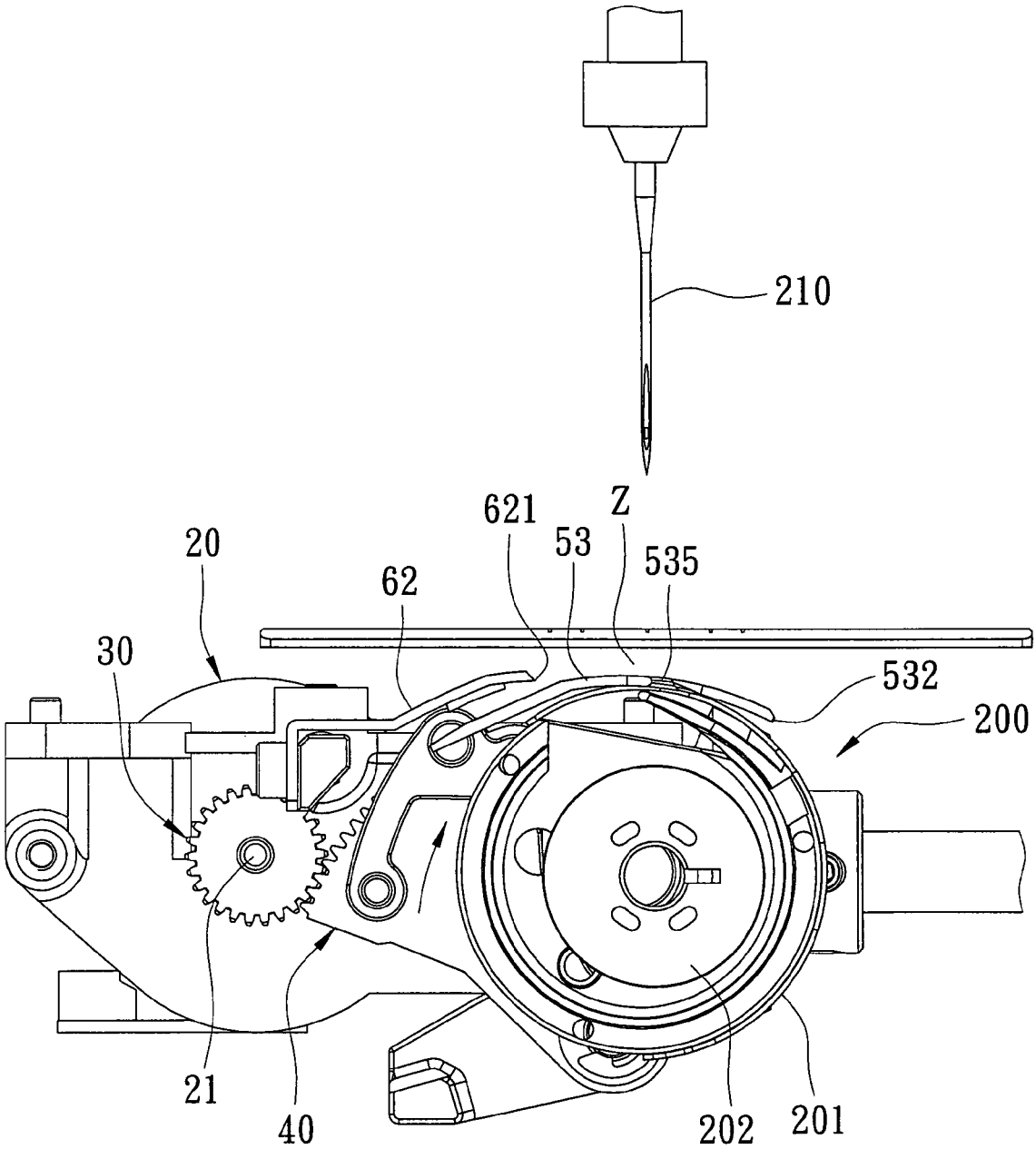
FIG. 4 is a schematic view of the preferred embodiment, showing the movable knife in a fetching position relative to the fixed knife.
Figure 5:
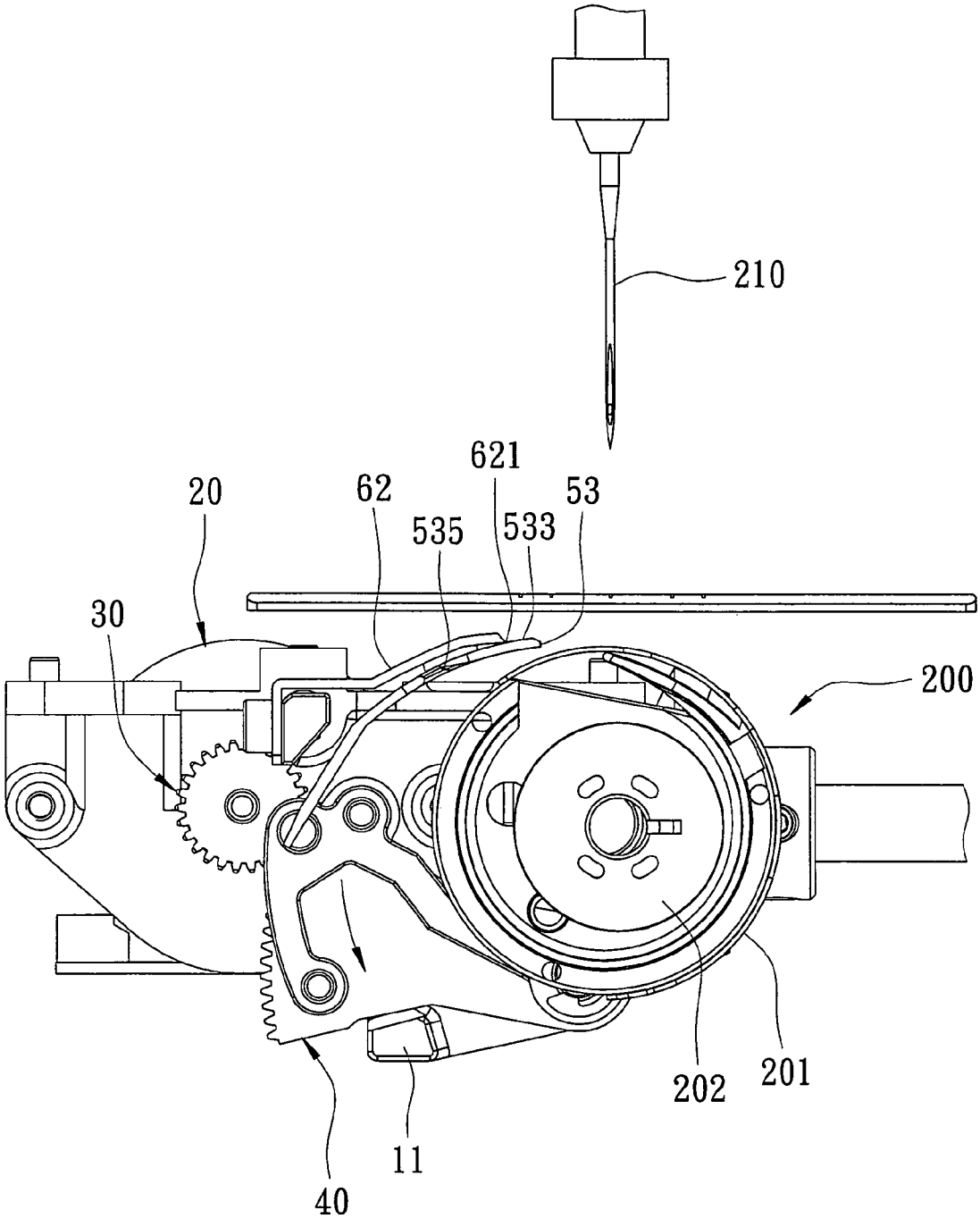
FIG. 5 is a schematic view of the preferred embodiment, showing the movable knife in a thread cutting position relative to the fixed knife.
Figure 6:
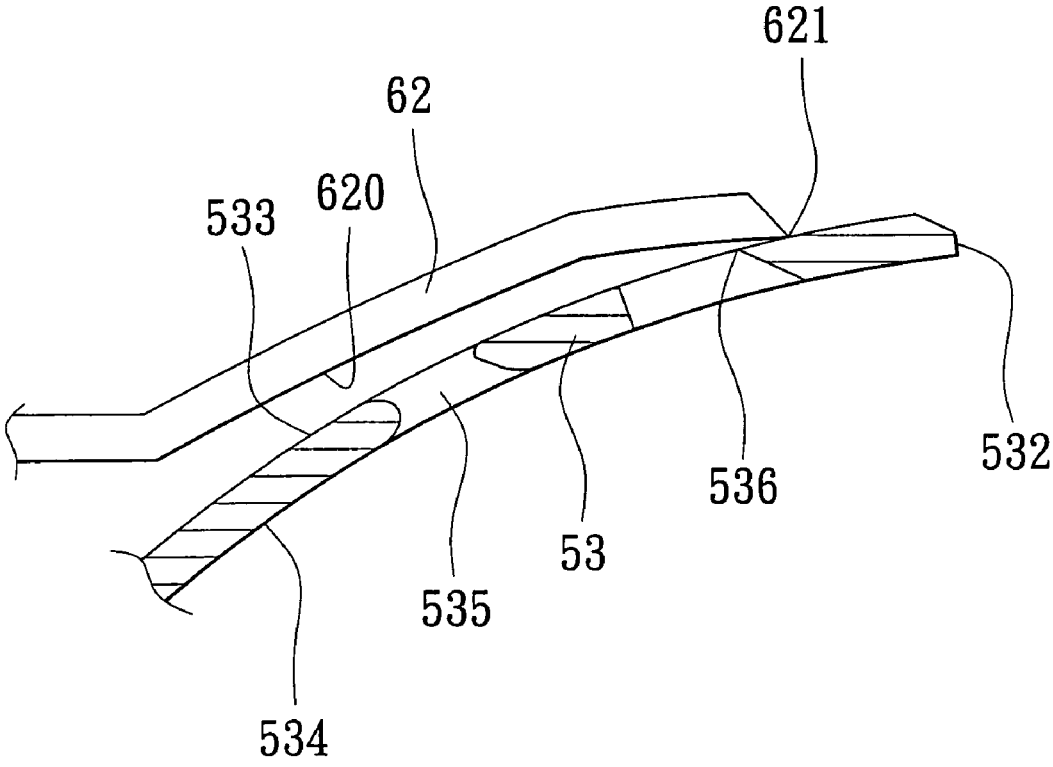
FIG. 6 is a fragmentary sectional view showing the movable and fixed knives of the preferred embodiment.

Referring to FIGS. 2 and 3, when a sewing operation is completed, and when the needle 210 is raised above the needle plate 140, the user can activate the servomotor 20 to turn the driven gear 40 so as to move the movable knife 53 from a starting position to the fetching position. When the probe end 532 is being moved toward the fetching position, the lateral edge surface 538 is brought to press against the tensed upper and lower threads, so that the tensed lower and upper threads sequentially slip from the lateral edge surface 538 into the cavity 535 to be thereby engaged in the cavity 535, as shown in FIG. 4. Thereafter, the servomotor 20 drives the driven gear 40 to turn in an opposite direction and to move the movable knife 53 from the fetching position to the thread cutting position. The second cutting edge 536 is brought to press the first cutting edge 621 so as to complete a cutting action, as shown in FIGS. 5 and 6. In this state, the driven gear 40 is stopped by the stop member 11 such that the movable knife 53 is returned to the starting position.

According to this embodiment, by means of the servomotor 20 which includes a step motor, a signal transmitter, a sensor, etc., and by means of the driving and driven gears 30,40, the movable knife 53 can be moved precisely for cutting both the upper and lower threads. As illustrated, the thread cutting device according to the present invention has a simple and inexpensive construction and is convenient to operate.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. A thread cutting device used for cutting both upper and lower threads in a sewing machine, the sewing machine including a base housing which has needle-bar side and bobbin side surfaces opposite to each other in an upright direction, a needle plate which is fitted in the needle-bar side surface, and which has a needle hole, a needle which is threaded with an upper thread, and which is disposed to reciprocate through the needle hole along a piercing path to thereby bring the upper thread to upper and lower limits alternately, a hook assembly which is spaced apart from the needle plate to define a thread fetching zone, and which has a rotating hook configured to travel around a first axis in a longitudinal direction that is transverse to the upright direction so as to form a looped segment of the upper thread by hooking up the upper thread from the needle, and a bobbin which is disposed to be reelable about the first axis in the hook assembly, and which is configured to tensely deliver a lower thread into the thread fetching zone so as to enable the lower thread to be interlocked with the upper thread through tying of the looped segment while the upper and lower threads are tensed, said thread cutting device comprising:

a drive motor which is a servomotor and which has an output shaft;

a fixed knife adapted to be disposed proximate to the bobbin side surface, and having a working-side wall which is disposed to face away from the bobbin side surface, which extends towards the thread fetching zone, and which terminates at a first cutting edge;

a mounting post which has an actuated end coupled with said drive motor so as to be moved angularly about a second axis that is parallel to the first axis, and a mount end that is opposite to said actuated end in the longitudinal direction;

a movable knife including a base end connected to said mount end so as to be movable between a fetching position and a thread cutting position, a probe end opposite to said base end in a lengthwise direction, and an intermediate segment interposed between said base end and said probe end, said movable knife having a sweeping surface which extends from said intermediate segment to said probe end, and which is disposed to confront said working-side wall, a hook confronting surface which is opposite to said sweeping surface, a lateral edge surface configured to connect said sweeping surface and said hook confronting surface, and having a cavity in said intermediate segment, said cavity extending transversely relative to the lengthwise direction to communicate said sweeping surface with said hook confronting surface such that, once said movable knife has reached the fetching position, the tensed lower and upper threads are engaged in the cavity, and a second cutting edge disposed on said sweeping surface between said probe end and said cavity, and configured such that, when said probe end is on the way to the thread cutting position, said second cutting edge is brought to press said first cutting edge so as to complete a cutting action;

a driving gear disposed to be rotated with said output shaft;

a mounting shaft disposed to extend along the second axis;

a driven gear including a pivoted end rotatably mounted on said mounting shaft about said second axis, a toothed segment which is opposite to said pivoted end radially, and which is meshed with said driving gear, and a web portion interposed between said pivoted end and said toothed segment; and a positioning member which is disposed to locate said actuated end of said mounting post at said web portion proximate to said toothed segment so as to angularly move said mounting post about the second axis.

2. The thread cutting device according to claim 1, wherein said movable knife is configured such that, when said probe end is on the way to the fetching position, said lateral edge surface is brought to press against the tensed lower and upper threads so that the tensed lower and upper threads slip from said lateral edge surface into said cavity.

3. The thread cutting device according to claim 1, wherein said second cutting edge is in form of an inner peripheral wall which extends transversely relative to the lengthwise direction to communicate said sweeping surface with said hook confronting surface.

4. The thread cutting device according to claim 1, wherein said fixed knife is configured to be cantilevered so as to vest said first cutting edge with yieldability when said second cutting edge is brought to press said first cutting edge.

* * * * *